United States Patent [19]

Hall et al.

[11] 4,064,824

[45] Dec. 27, 1977

[54] HYDRAULICALLY POWERED MARINE PROPULSION TILTING AND TRIMMING SYSTEM WITH MEMORY

[75] Inventors: Charles B. Hall, Ingleside, Ill.; Robert F. Young, Kenosha, Wis.

[73] Assignee: Outboard Marine Corporation, Waukegan, Ill.

[21] Appl. No.: 670,055

[22] Filed: Mar. 24, 1976

Related U.S. Application Data

[63] Continuation-in-part of Ser. No. 571,077, April 24, 1975, abandoned.

[51] Int. Cl.[2] ..... B63H 5/12

[52] U.S. Cl. ..... 115/41 HT

[58] Field of Search ..... 115/41 HT, 41 R, 34 R

[56] References Cited

U.S. PATENT DOCUMENTS

| | | | |
|---|---|---|---|
| 3,654,889 | 4/1972 | Bergstedt | 115/41 HT |
| 3,799,104 | 3/1974 | Kurling | 115/41 HT |
| 3,885,517 | 5/1975 | Borst et al. | 115/41 HT |

*Primary Examiner*—George E. A. Halvosa
*Assistant Examiner*—Gregory W. O'Connor
*Attorney, Agent, or Firm*—Michael, Best & Friedrich

[57] ABSTRACT

A propulsion assembly includes hydraulic trim and tilt cylinders and a reversible pump effective when operating in a first mode, to supply hydraulic fluid under pressure to a first port and to provide suction at a second port and effective when operating in a second mode, to supply hydraulic fluid under pressure to the second port and to provide suction at the first port, a first conduit communicating between one end of the tilt cylinder and the first pump port and including a first valve biased so as to releasably prevent flow from the first end of the tilt cylinder to the first pump port and so as to permit fluid flow from the first pump port to the first end of the tilt cylinder in response to the presence of hydraulic fluid under pressure at the first pump port, a second conduit communicating between the first end of the trim cylinder and the first pump port independently of the first conduit, and a piston communicating with the second pump port for actuating the first valve against the bias thereof and in response to the presence of hydraulic fluid under pressure at the second pump port so as to permit hydraulic fluid flow from the first end of the tilt cylinder to the first pump port without affecting the trim cylinder-piston assembly.

24 Claims, 2 Drawing Figures

HYDRAULICALLY POWERED MARINE PROPULSION TILTING AND TRIMMING SYSTEM WITH MEMORY

RELATED APPLICATION

This application is a continuation-in-part of my copending application Ser. No. 571,077, filed Apr. 24, 1975, now abandoned.

BACKGROUND OF THE INVENTION

The invention relates generally to marine propulsion devices such as outboard motors and stern drive units.

The invention also relates to arrangements for tilting and trimming the propulsion assemblies of such marine propulsion devices.

The invention further relates to hydraulically operated trimming and tilting arrangements for the propulsion assemblies of such marine propulsion devices.

Attention is directed to the following prior United States Patents:

Mercier U.S. Pat. No. 3,508,400, issued Apr. 28, 1970.

Carpenter U.S. Pat. No. 3,722,455, issued Mar. 27, 1973.

Kurling U.S. Pat. No. 3,799,104, issued Mar. 26, 1974.

Shimanckas U.S. Pat. No. 3,847,198, issued Nov. 12, 1974.

Borst U.S. Pat. No. 3,863,592, issued Feb. 4, 1975.

Borst U.S. Pat. No. 3,885,517, issued May 27, 1975.

SUMMARY OF THE INVENTION

The invention provides a marine propulsion device including a member adapted to be attached to a boat hull, propulsion assembly pivotally connected to the member for vertical swinging movement when the member is attached to the boat hull, a tilt hydraulic cylinder-piston assembly connected between the member and the propulsion assembly and including a tilt cylinder having opposed first and second ends, a trim hydraulic cylinder-piston assembly including a trim cylinder fixed relative to one of the member and the propulsion assembly, having opposed first and second ends, and having therein a reciprocably movable trim piston having a piston rod extending through one of said ends of the trim cylinder and adapted for releasable engagement with the other of the member and the propulsion assembly, a reversible pump including first and second ports, which pump is operative, when the pump is operating in a first mode, to supply hydraulic fluid under pressure at the first port and to provide suction at the second port and is operative, when the pump is operating in a second mode, to supply hydraulic fluid under pressure at the second port and to provide suction at the first port, first conduit means communicating between the first end of the tilt cylinder and the first pump port and including a first valve biased so as to releasably prevent flow from the first end of the tilt cylinder to the first pump port and so as to permit fluid flow from the first pump port to the first end of the tilt cylinder in response to the presence of hydraulic fluid under pressure at the first pump port, second conduit means communicating between the first end of the trim cylinder and the first pump port, third conduit means communicating between the second pump port and the second ends of the trim cylinder and the tilt cylinder, and means communicating with the second pump port for actuating the first valve against the bias thereof and in response to the presence of hydraulic fluid under pressure at the second pump port so as to permit hydraulic fluid flow from the first end of the tilt cylinder to the first pump port.

In accordance with one embodiment of the invention, the first valve includes a valve seat, a valve member movable relative to the valve seat between an open position permitting fluid flow through the first valve and a closed position preventing fluid flow through the first valve, and a spring biasing the valve member toward the closed position.

In accordance with an embodiment of the invention, the means for actuating the first valve comprises a housing having therein a cylinder with a first end communicating with the second pump port, a second end communicating with the first conduit means intermediate the first valve and the first pump port, and a piston located in the cylinder intermediate the ends thereof and movable in the cylinder relative to a position engaging the valve member to displace the valve member to the open position in response to the presence of hydraulic fluid under pressure at the first cylinder end.

In accordance with an embodiment of the invention, the housing includes a portion of the first conduit means including the valve seat and the valve member and the spring are located in the housing.

In accordance with an embodiment of the invention, the first and second conduit means communicate with the first pump port independently of each other.

In accordance with an embodiment of the invention, the marine propulsion device also includes a shuttle valve housing having a first end communicating between the first pump port and the first and second conduit means, and a second end communicating between the second pump port and the third conduit means. In addition, there is provided a second valve which is normally closed and which communicates between the first end of the shuttle valve housing and the second conduit means and is arranged to releasably prevent fluid flow therethrough to and from the first end of the shuttle valve housing, and a third valve which is normally closed and which communicates between the second end of the shuttle valve housing and the third conduit means and which is arranged to releasably prevent flow therethrough to and from the second end of the shuttle valve housing. Still further in addition, the first conduit means communicates through the first end of the shuttle valve housing with the first pump port.

Located in the shuttle valve housing is a shuttle piston movable relative to a centered position located midway between the first and second ends of the shuttle valve housing, a first end position located adjacent to the first end of the shuttle valve housing, and a second end position located adjacent to the second end of the shuttle valve housing, together with means on the piston opening the second valve when the piston is in the first end position, and means on the piston opening the third valve when the piston is in the second end position.

In accordance with one embodiment of the invention, the marine propulsion device further includes additional conduit means communicating between the first and second ends of the tilt cylinder and including means operative for temporarily affording hydraulic fluid flow from the first end of the tilt cylinder to the second end of the tilt cylinder in response to the generation of relatively high pressure adjacent the second end of the tilt cylinder occurring incident to the striking of an underwater obstacle.

One of the principal features of the invention is the provision of an improved selectively operable hydraulic system for power raising and lowering a propulsion assembly of a marine propulsion device.

One of the principal features of the invention is the provision of a marine propulsion device which includes a hydraulic system for raising and lowering a propulsion assembly, which hydraulic system includes provision for insuring return of the propulsion assembly to a previously set trim position after the striking of an underwater obstacle.

Another of the principal features of the invention is the provision of a power operated hydraulic system for trimming and tilting the propulsion assembly of a marine propulsion device, which system includes means for affording automatic let-down of the propulsion assembly after the striking of an underwater obstacle to a previously set trim position.

Other features and advantages of the embodiments of the invention will become apparent from the following general description, claims and appended drawings.

THE DRAWINGS

Figure 1:
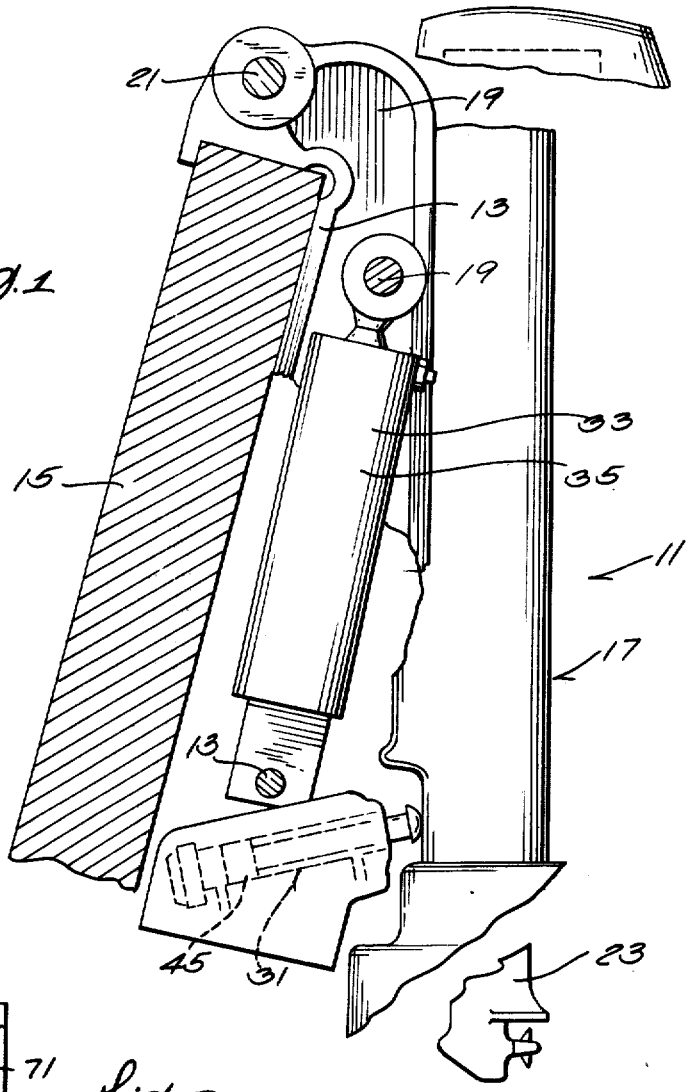
FIG. 1 is a partially schematic side-elevation view, partially in section, of a marine propulsion device incorporating various of the features of the invention.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for purpose of description and should not be regarded as limiting.

GENERAL DESCRIPTION

Shown in the drawings is a marine propulsion device which is shown schematically in the form of an outboard motor 11 including a member 13 adapted to be suitably attached to a boat hull 15, and a propulsion assembly 17 connected to the member 13 for vertical swinging movement between a fully lowered position and a fully raised position when the member 13 is connected to the boat hull 15. Any suitable form of propulsion assembly can be employed, including, for instance, a swivel bracket 19 connected to the member 13 about a horizontal tilt pin 21 and a propulsion unit 23 connected to the swivel bracket 13 for steering movement relative thereto. The invention is equally applicable to stern drive units and to outboard motors.

Figure 2:
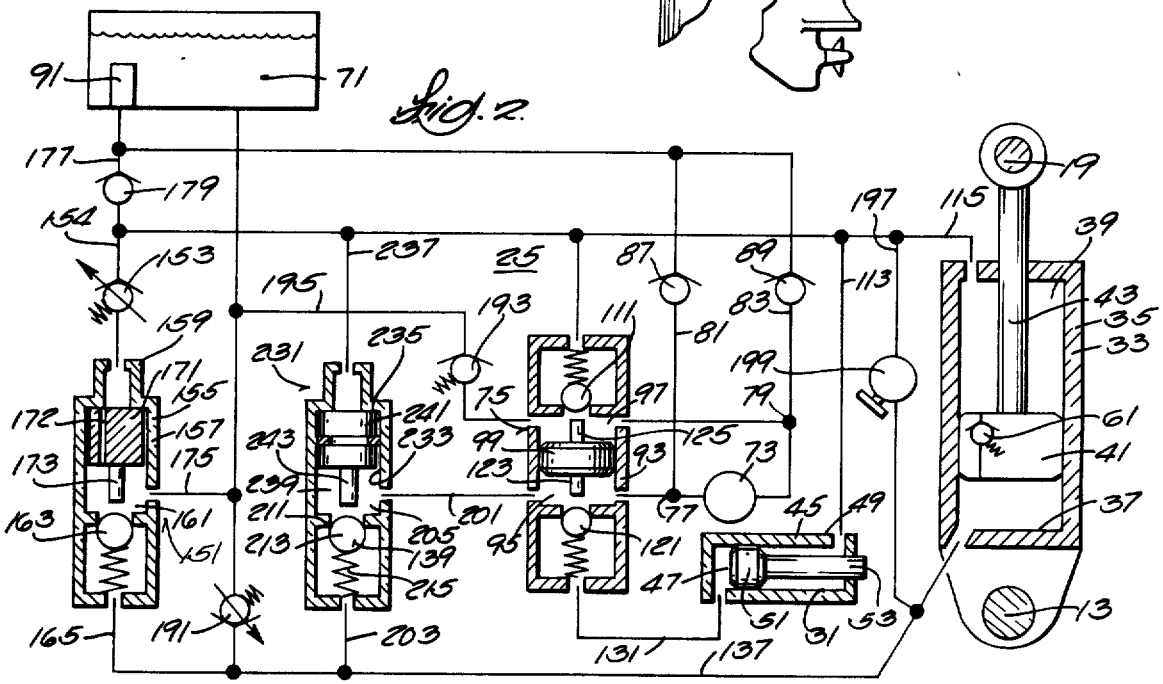
FIG. 2 is a schematic diagram of the hydraulic system incorporated in the marine propulsion device shown in FIG. 1.

Connected between the member 13 and the propulsion assembly 17 is (See Fig. 2) a hydraulic system 25 for tilting and trimming the propulsion assembly 17 relative to the boat mounted member 13. As used herein, "trimming" refers to angular adjustment or movement within a trim range extending up and from the fully lowered position of the propulsion assembly 17 and "tilting" refers to angular adjustment or movement within a tilt range extending upwardly from the top of the trim range to the fully elevated or raised position of the propulsion assembly 17.

The hydraulic system 25 includes one or more trim and tilt hydraulic cylinder-piston assemblies 31 and 33, respectively, which are connected between the member and the propulsion assembly. More particularly, the tilt cylinder-piston assembly 33 comprises a tilt cylinder 35 which has opposed first and second ends 37 and 39, respectively, which, at its first end 37, is pivotally connected to one of the member 13 and the propulsion assembly 17, and which contains a tilt piston 41 connected to a piston rod 43 which extends through the second tilt cylinder end 39 and is pivotally connected to the other of the member 13 and the propulsion assembly 17. Preferably, the tilt cylinder-piston assembly is connected between the member 13 and the swivel bracket 19 and the first end 37 of the tilt cylinder 35 is pivotally connected to the member 13 and the piston rod 43 is pivotally connected to the swivel bracket 19.

The trim cylinder-piston assembly 33 comprises a trim cylinder 45 which has opposed first and second ends 47 and 49, respectively, which is fixed to one of the member 13 and the propulsion assembly 17 and which includes a trim piston 51 connected to a piston rod 53 which extends through the second end 49 of the trim cylinder 45, and which is releasably engagable with the other of the member 13 and the propulsion assembly 17. Preferably, the trim cylinder 45 is fixed to the member 13 and the piston rod 53 is releasably engagable with the swivel bracket 19.

Located in the tilt piston 41 is a one way valve 61 which is in the form of a spring biased ball check valve and which prevents flow from the first end 37 of the tilt cylinder 35 to the second end 39, but which permits flow from the second end 39 of the tilt cylinder 35 to the first end 37 of the tilt cylinder 35 so that, in the event the propulsion assembly 17 impacts an underwater obstacle and the tilt cylinder 35 accordingly extends rapidly, the valve 61 will accommodate flow from the second end 39 of the tilt cylinder 35 through the tilt piston 41 to the first end 37 of the tilt cylinder 35. The bias on the valve 61 is relatively high, for instance, about 2500 lbs./sq/in.

The hydraulic system 25 also includes hydraulic fluid supply and control means for selectively supplying the trim and tilt cylinder-piston assemblies 31 and 33 with hydraulic fluid. While various means can be employed, in the illustrated construction, such means comprises a reservois or sump 71, a pump 73 operably connected to the sump 71, a shuttle valve 75 connected to the pump 73, and valved fluid conduits communicating between the shuttle valve 73 and the tilt and trim cylinders 35 and 45.

More specifically, the pump 73 is in the form of a reversible pump which includes first and second fluid connections or ducts or ports 77 and 79, respectively, which are arranged so that, when the pump 73 is rotating in one direction, the first duct or port 77 is supplied fluid under pressure and the second duct or port 79 is subject to a suction condition and so that, when the pump 73 is running in the opposite direction, the duct or port 79 is supplied hydraulic fluid under pressure and the first duct or port 77 is subject to a suction condition. In addition, the ducts or ports 77 and 79 are respectively connected through conduits 81 an 83 with the reservoir 71. In turn, the conduits 81 and 83 include respective one-way valves 87 and 89 permitting flow to the pump 73 and preventing flow to the reservoir 71. Preferably, the conduits 81 and 83 communicate with the sump or reservoir 71 through a common filter 91.

The shuttle valve 75 comprises a housing 93 which has opposing first and second ends 95 and 97 communicating respectively with the ducts or ports 77 and 79 so that the first end 95 of the housing 93 is pressurized when the pump 73 is rotating in one direction and so that the second end 97 of the housing 93 is pressurized when the pump 73 is rotating in the other direction. The shuttle valve 75 includes therein a piston 99 movable from a centered postition to each of first and second end positions respectively adjacent to the first and second ends 95 and 97 of the housing 93.

Communicating with the second end 97 of the valve housing 93 is a spring biased, normally closed valve 111 which also communicates through respective conduits 113 and 115 with the second end 49 of the trim cylinder 45 and with the second end 39 of the tilt cylinder 35. Communicating with the first end 95 of the control valve housing 93 is another spring biased, normally closed valve 121 which communicates directly with the first end 47 of the trim cylinder 45 through a conduit 131.

Means are provided on the shuttle valve piston 99 in the form of oppositely extending projections 123 and 125 for respectively opening the valves 121 and 111 when the shuttle valve piston 99 is located in the first and second end positions. More specifically, when the first end 95 of the shuttle valve housing 93 is pressurized, the projection 125 opens the valve 111 to permit fluid flow into the housing 93 from the second end 39 of the tilt cylinder 35 and from the second end 49 of the trim cylinder.

When the second end 97 of the control valve housing 93 is pressurized, the projection 123 opens the valve 121 to permit inflow of hydraulic fluid from the first end 47 of the trim cylinder 45.

When the pump 73 is not operating, the piston 99 is located in its centered position and both valves 111 and 121 are closed by their respective springs.

Communicating with the first end 37 of the tilt cylinder 35 is a conduit 137 which includes a normally closed valve 139 and which extends to the first end 95 of the shuttle valve housing 93 and therefore, in effect, communicates directly with the first pump port 77. The valve 139 is biased so as to releasably prevent flow from the first end 37 of the tilt cylinder 35 and so as to permit flow from the first pump port 77 to the first end 37 of the tilt cylinder 35 in response to the presence of hydraulic fluid under pressure at the first pump port 77.

Means are also provided for actuating the valve 139 against the bias thereof so as to permit hydraulic fluid flow from the first end 37 of the tilt cylinder 35 to the first pump port 77 in response to the presence of the hydraulic fluid under pressure at the second pump port 79. While other constructions could be employed, in the illustrated construction, the conduit 137 includes a portion 201 communicating through the first end 95 of the shuttle valve housing 93 with the first pump port 77, another portion 203 communicating with the first end 37 of the tilt cylinder 35, and an intermediate portion 205.

While other constructions could be employed, in the illustrated construction, the valve 139 includes a valve seat 211 included in the intermediate portion 205 of the conduit 137, together with a valve member 213 which is in the form of a ball and which is movable relative to the valve seat 211 between an open position permitting hydraulic fluid flow through the valve 139 and a closed position preventing hydraulic fluid flow through the valve 139, and a spring 215 biasing the valve member 213 towards the closed position.

While other constructions could be employed, in the illustrated construction, the intermediate conduit portion 205, the valve 139, and the valve actuating means are incorporated in a housing 231 which includes a cylinder 233 having a first end 235 communicating through a conduit 239 with the second pump port 79, together with a second end 239 communicating with the intermediate conduit portion 205. In the specifically illustrated construction, the conduit 237 communicates with the second pump port 79 through the valve 111 and through the second end 97 of the shuttle valve housing 93. In addition, the cylinder 233 includes a piston 241 located intermediate the ends 233 and 239 of the cylinder 233 and having a projection 243 extending towards the valve member 213. The piston is movable, in response to the pressure of hydraulic fluid under pump pressure at the first end 235 of the cylinder 233, to a position with the projection 243 engaging the valve member 213 so as to displace the valve member 213 to the open position. In addition, the piston 241 is movable away from the position opening the valve member 213 in response to the presence at the second end 239 of the cylinder 233, i.e., in the intermediate conduit portion 205, of hydraulic fluid under pump pressure.

The hydraulic system 25 also includes let-down means providing automatic transfer of hydraulic fluid from the first end 37 of the tilt cylinder 35 to the second end 39 of the tilt cylinder 35 in order to accommodate let-down of the propulsion assembly 17 after the striking of an underwater obstacle. More particularly, there is hydraulically connected between the ends 37 and 39 of the tilt cylinder 35 an automatic let-down assembly 151 which includes an actuating valve 153 which is in the form of a normally closed spring biased check valve, and which communicates through a conduit 154 with the second end 39 of the tilt cylinder 35 and which is arranged to prevent flow to the second end 39 of the tilt cylinder 35 and to releasably prevent or permit flow from the second end 39 of the tilt cylinder 35 therethrough. The bias on the valve 153 is relatively high, for instance, about 2500 lbs./sq.in.

Also included in the let-down valve assembly 151 is a letdown valve 155 including a housing 157 having a first end 159 communicating with the valve 153 and a second end 161 communicating with a by-pass valve 163 which is in the form of a normally closed spring biased check valve and which, in turn, communicates through a conduit 165 with the portion 203 of the conduit 137 which, in turn, communicates with the first end 37 of the tilt cylinder 35. The bias on the valve 163 is relatively low, for instance, about 25 lbs./sq.in.

Located within the let-down valve housing 159 is a let-down piston 171 which is movable between a first position adjacent to the first end 159 of the let-down valve housing 157 and a second position spaced from the first position in the direction toward the second end 161 of the let-down valve housing 157. The let-down piston 171 includes a restricted orifice or slot 172 which communicates between the first and second ends of the let-down valve housing 157. In addition, the let down piston 171 also includes a projection 173 which is operable, upon movement of the piston 171 to the second position, to open the valve 163 so as to permit fluid flow from the first end 37 of the tilt cylinder 35 into the let-down valve housing 157.

Communicating between the second end of the let-down valve housing 157 and the second end 39 of the tilt cylinder 35 is conduit means including a conduit 175 extending from adjacent the second end 161 of the let-down valve housing 157 to the sump 71, and a conduit 177 extending from the sump 71 to the second end 39 of the tilt cylinder 35 and including a one-way valve 179 preventing flow to the sump 71 and permitting flow from the sump 71. Included in the conduit 177 is the filter 91.

The hydraulic system 25 also includes a normally closed overload or relief valve 191 which communicates with the conduits 137 and 165 and with the conduit 175 and which is in the form of a normally closed spring biased check valve arranged so as to permit flow from the condiuts 137 and 165 to the conduit 175 and to prevent flow from the conduit 175 to the conduits 137 and 165 and hence to permit hydraulic fluid flow from the first end 37 of the tilt cylinder 35 to the sump 71 in the event excess thrust is developed during operation of the propulsion assembly 17. In addition, when the shuttle valve pistion 99 is in the position providing power operated upward movement of the propulsion assembly 17, the overload valve 191 prevents overloading of the pump 73 by permitting bypassing of the pressure fluid to the sump 71 whenever movement of the trim piston 51 or tilt piston 41 is blocked, or when the propulsion assembly 17 is in the fully raised position. It is noted that the spring bias on the valve 191 is greater than the spring bias on the valve 139.

The hydraulic system 25 also includes a pressure relief valve 193 which communicates with the sump 71 through a conduit 195 which communicates with the second end 97 of the shuttle valve housing 93, and which is operative to permit flow from the second end 97 of the shuttle valve housing 93 to the sump 71 in the event of excess pressure when the shuttle piston 99 is in the position providing power operated lowering of the propulsion assembly. In addition, the relief valve 193 also operates, when the shuttle valve piston 99 is in the position affording power operated raising of the propulsion assembly 17, to prevent the relatively high pressures resulting from impact or shock absorption from adversely affecting the pump 73. The pressure relief valve 193 is preferably in the form of a normally closed, spring biased check valve and has a spring bias which is greater than the valve 111.

The hydraulic system 25 also includes a conduit 197 which connects the opposed ends 37 and 39 of the tilt cylinder 35 and which includes a manually operable valve 199 permitting bypass of fluid around the tilt piston 41 to accommodate manual raising and lowering of the propulsion assembly 17.

In operation and when it is desired to raise the propulsion assembly 17 by power operation, the pump 73 is operated in the proper direction to pressurize the first end 95 of the shuttle valve housing 93 so as to displace the piston 99 toward the end 97 of the shuttle valve housing 93, thereby opening the adjacent valve 111. At the same time, the pump pressure opens the other valve 121 against its spring to supply pressure fluid through the conduit 131 to the first end 47 trim cylinder 45. In addition, pressurized hydraulic fluid through the conduit 137 and through the valve 139 to the first end 37 tilt cylinder 35.

At the same time, hydraulic fluid adjacent to the second end 39 of the tilt cylinder 35 and hydraulic fluid adjacent to the second end 49 of the trim cylinder 45 flows through the conduits 113 and 115 past the open valve 111 through the second end 97 of the valve housing 93 and through the second duct or port 79 to the intake of the pump 73. Make-up fluid is drawn from the sump 71 through the conduit 83 and through the check valve 89.

In the event there is an obstruction to upward travel of the propulsion assembly 17 or at the end of such travel, the hydraulic fluid supplied by the pump 73 flows back to the sump 71 through the conduit 137 including the valve 139, through the conduit 165, and through the overload valve 191 which operates as a pressure relief valve, and through the conduit 175 to the sump 71.

During power operated lowering of the propulsion assembly 17, the pump 73 is operated in the opposite directed, and serves to deliver hydraulic fluid through the second duct or port 79 to the second end 97 of the shuttle valve housing 93, thereby opening the adjacent valve 111 and displacing the shuttle valve piston 99 to the position adjacent the first end 95 of the shuttle valve housing 93 so as to also open the valve 121. Hydraulic fluid flows through the valve 111 and through the conduit 113 to the second end 49 of the trim cylinder 45 so as to retract the piston rod 51 and through the conduit 115 to the second end 39 of the tilt cylinder 35 to contract the trim cylinder-piston assembly 31.

At the same time, hydraulic fluid flows through the conduit 237 and acts against the piston 241 to displace the piston 241 so as to open the valve 139 against the action of the spring 215 and thereby to permit flow of hydraulic fluid from the first end 37 of the tilt cylinder 35 back to the first pump port 77 return to the pump 73.

Also during power operated lowering of the propulsion assembly 17, hydraulic fluid from the first end 47 of the trim cylinder 45 flows through the conduit 131 and valve 121 to the first pump port 37 for return to the pump 73.

If there is an obstruction to movement of the propulsion assembly 17, or at the end of such movement when the propulsion assembly 17 is in the fully lowered position, pressure fluid produced by the pump 73 is returned to the sump 71 via the pressure relief valve 193 through the conduit 195. Fluid is supplied to the pump 73 from the sump 71 for priming purposes through the conduit 81 and check valve 87.

In the event the propulsion assembly 77 strikes an underwater obstacle, sudden upward movement of the propulsion assembly 17 will cause extension of the tilt cylinder 35 and consequent immediate relatively high pressurization of the hydraulic fluid adjacent to the second end 39 of the tilt cylinder 35. Under such circumstances, the hydraulic fluid flows past the tilt piston 41 through the valve 61 from the second end 39 to the first end 37 of the tilt cylinder 35 so as to permit such extension. As the pump 73 is not running, the shuttle valve piston 99 is centered and both valves 111 and 121 are closed. During the period when the second end 39 of the tilt cylinder 35 is highly pressurized, such pressurization will be imparted through the conduit 154 to open the valve 153 so as to permit passage of a relatively small amount of highly pressurized hydraulic fluid therethrough to the first end 159 of the let-down valve housing 157, which fluid is effective to displace the let-down piston 171 from the first position to the second position.

Upon full extension of the tilt cylinder 35, the pressure condition at the second end 39 thereof will be relieved and the valve 153 will again close preventing return of the hydraulic fluid at the first end 159 of the let-down valve housing 157 through the valve 153 to the second end 39 of the tilt cylinder 35, thereby temporarily retaining the let-down valve piston 171 in the second position so as thereby to retain the valve 163 open.

Upon reaching the fully raised position, the propulsion assembly 17 will tend to return downwardly either because of impacting at the fully raised position or simply because of the weight of the motor. Temporary maintenance of the open condition of the valve 163 by the let-down valve piston 171 permits contraction of the tilt cylinder 35 accompanying lowering of the propulsion assembly 17. In this regard, contraction of the tilt cylinder 35 causes outflow of hydraulic fluid from the first end 37 thereof, which outflow travels through the conduit 165, through the valve 163 into the second end 161 of the let-down valve housing 157 and through the conduit 175 back to the sump 71. At the same time, the expanding space at the second end 39 of the tilt cylinder 35 draws hydraulic fluid from the sump 71 through the filter 91, and through the conduit 177 including the one-way valve 179 to the second end 39 of the tilt cylinder 35 to maintain the second end 39 of the tilt cylinder 35 fully occupied with hydraulic fluid.

Referring to the hydraulic fluid trapped at the first end 159 of the let-down valve housing 157, such fluid gradually flows through the restricted orifice or slot 172 to the second end 161 of the let-down valve housing 157 and then through the conduit 175 to the sump 71. Such travel of the trapped fluid past the let-down piston 171 causes return movement of the let-down piston 171 toward the first end 159 of the let-down valve housing 157 under the influence of the spring biasing the valve 163 to the closed position, thereby eventually again permitting closing the valve 163 after completion of fluid flow from the first end 37 of the tilt cylinder 35 to the sump 71. Thus, the hydraulic system 25 is again conditioned for power operation, up or down, or for another impact.

Pressurization of the hydraulic fluid at the second end 39 of the tilt cylinder 35 also serves to pressurize the hydraulic fluid at the first end 235 of the valve housing 231. Such pressurization causes movement of the piston 241 so as to displace the valve member 213 to the open position. However, as hydraulic fluid at the first end 37 of the tilt cylinder 35 is not under pressure during upward swinging of the propulsion assembly 171, there is no flow through the valve 139. When the propulsion assembly 17 starts its downward movement, the pressure of the hydraulic fluid at the first end 235 of the housing 231 is relieved and the spring 215 serves to displace the valve member 213 to the closed position and to return the piston 241 toward the first end 235 of the housing 231. Thus, although the valve 139 is opened in response to the striking of an underwater obstacle, such opening does not result in any material flow of hydraulic fluid through the valve 139.

It is particularly noted that the first end 37 of the tilt cylinder 35 is hydraulically isolated from the first end 47 of the trim cylinder 45 as the trim cylinder 45 is connected to the first pump port 77 through the conduit 131 and valve 121 independently of connection of the tilt cylinder 35 to the first pump port 77 through the conduit 137 and valve 139. Thus, hydraulic flow relative to the tilt cylinder 35 occurring consequent to the striking of an underwater obstacle does not affect the position of the trim piston 51. Thus, the trim piston 51 does not move during impact tilting or letdown return, and thus the propulsion assembly 17 will always return after an impact to the previously set trim position. It is also noted that the pump 73 is isolated from the relatively high pressures generated in the second end 93 of the tilt cylinder 35 by sudden impact of the propulsion assembly 17 with an underwater obstacle by reason of the centered position of the valve piston 99 and the closed condition of the valve 111.

Various of the features of the invention are set forth in the following claims.

What is claimed is:

1. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through one of said ends of said trim cylinder and adapted for releasable engagement with the other of said member and said propulsion assembly, a reversible pump including first and second ports, said pump being operative, when said pump is operating in a first mode, to supply hydraulic fluid under pressure at said first port and to provide suction at said second port and being operative, when said pump is operating in a second mode, to supply hydraulic fluid under pressure at said second port and to provide suction at said first port, first conduit means communicating between said first end of said tilt cylinder and said first pump port and including a first valve biased so as to releasably prevent flow from said first end of said tilt cylinder to said first pump port and so as to permit fluid flow from said first pump port to said first end of said tilt cylinder in response to the presence of hydraulic fluid under pressure at said first pump port, second conduit means communicating between said first end of said trim cylinder and said first pump port independently of said first valve means, said second conduit means including a second valve biased so as to releasably prevent flow from said first end of said trim cylinder to said first port and so as to permit fluid flow from said first pump port to said first end of said trim cylinder in response to the presence of hydraulic fluid under pressure at said first pump port and independently of said first valve means, and third conduit means communicating between said second pump port and said second ends of said trim cylinder and said tilt cylinder.

2. A marine propulsion device in accordance with claim 1 wherein said first valve includes a valve seat, a valve member movable relative to said valve seat between an open position permitting fluid flow through said first valve and a closed position preventing fluid flow through said first valve, and a spring biasing said valve member toward said closed position, and wherein said means for actuating said first valve comprises a housing having therein a cylinder with a first end communicating with said second pump port, a second end communicating with said first conduit means intermediate said first valve and said first pump port, and a piston located in said cylinder intermediate the ends thereof and being movable in said cylinder relative to a position engaging said valve member to displace said valve member to said open position in response to the presence of hydraulic fluid under pressure at said first cylinder end.

3. A marine propulsion device in accordance with claim 2 wherein said housing includes a portion of said first conduit means including said valve seat and wherein said valve member and said spring are located in said housing.

4. A marine propulsion device in accordance with claim 1 and further including means communicating with said second pump port for actuating said first valve against the bias thereof and in response to the presence of hydraulic fluid under pressure at said second pump port so as to permit hydraulic fluid flow from said first end of said tilt cylinder to said first pump port.

5. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through one of said ends of said trim cylinder and adapted for releasable engagement with the other of said member and said propulsion assembly, a reversible pump including first and second ports, said pump being operative, when said pump is operating in a first mode, to supply hydraulic fluid under pressure at said first port and to provide suction at said second port and being operative, when said pump is operating in a second mode, to supply hydraulic fluid under pressure at said second port and to provide suction at said first port, first conduit means communicating between said first end of said tilt cylinder and said first pump port and including a first valve biased so as to releasably prevent flow from said first end of said tilt cylinder to said first pump port and so as to permit fluid flow from said first pump port to said first end of said tilt cylinder in response to the presence of hydraulic fluid under pressure at said first pump port, second conduit means communicating between said first end of said trim cylinder and said first pump port, third conduit means communicating between said second pump port and said second ends of said trim cylinder and said tilt cylinder, means communicating with said second pump port for actuating said first valve against the bias thereof and in response to the presence of hydraulic fluid under pressure at said second pump port so as to permit hydraulic fluid flow from said first end of said tilt cylinder to said first pump port, a shuttle valve housing having a first end communicating between said first pump port and said first and second conduit means, and a second end communicating between said second pump port and said third conduit means, a second valve which is normally closed and which communicates between said first end of sad shuttle valve housing and said second conduit means and is arranged to releasably prevent fluid flow therethrough to and from said first end of said shuttle valve housing, and a third valve which is normally closed and which communicates between said second end of said shuttle valve housing and said third conduit means and which is arranged to releasably prevent flow therethrough to and from said second end of said shuttle valve housing.

6. A marine propulsion device in accordance with claim 5 and further including a shuttle piston located in said shuttle valve housing and movable relative to a centered position located midway between said first and second ends of said shuttle valve housing, a first end position located adjacent to said first end of said shuttle valve housing and a second end position located adjacent to said second end of said shuttle valve housing, means on said piston opening said second valve when said piston is in said first end position, and means on said piston opening said third valve when said piston is in said second end position.

7. A marine propulsion device in accordance with claim 5 wherein said third valve includes means biasing said third valve toward the normally closed condition, and further including a relief valve which is normally closed and which communicates with said second end of said shuttle valve housing and with a sump, said relief valve including means biasing said relief valve toward the normally closed condition, said biasing means of said relief valve having greater resistance than said biasing means of said third valve.

8. A marine propulsion device in accordance with claim 1 and furhter including a normally closed relief valve communicating between said first conduit means and a sump and arranged to afford fluid flow from said first conduit means in the event of a pressure therein above a predetermined level.

9. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through one of said ends of said trim cylinder and adapted for releasable engagement with the other of said member and said propulsion assembly, a reversible pump including first and second ports, said pump being operative, when said pump is operating in a first mode, to supply hydraulic fluid under pressure at said first port and to provide suction at said second port and being operative, when said pump is operating in a second mode, to supply hydraulic fluid under pressure at said second port and to provide suction at said first port, first conduit means communicating between said first end of said tilt cylinder and said first pump port and including a first valve biased so as to releasably prevent flow from said first end of said tilt cylinder to said first pump port and so as to permit fluid flow from said first pump port to said first end of said tilt cylinder in response to the presence of hydraulic fluid under pressure at said first pump port, second conduit means communicating between said first end of said trim cylinder and said first pump port, third conduit means communicating between said second pump port and said second ends of said trim cylinder and said tilt cylinder, means communicating with said second pump port for actuating said first valve against the bias thereof and in response to the presence of hydraulic fluid under pressure at said second pump port so as to permit hydraulic fluid flow from said first end of said tilt cylinder to said first pump port, additional conduit means communicating between said first and second ends of said tilt cylinder and including means operative for temporarily affording fluid flow from said first end of said tilt cylinder to said second end of said tilt cylinder in response to the generation of relatively high pressure adjacent said second end of said tilt cylinder occurring incident to the striking of an underwater obstacle.

10. A marine propulsion device in accordance with claim 9 wherein said means for temporarily affording fluid flow from said first end of said tilt cylinder to said second end of said tilt cylinder comprises a by-pass valve communicating between said first end of said tilt cylinder and said second end of said tilt cylinder, said by-pass valve being biased to releasably prevent fluid flow therethrough from said first end of said tilt cylinder, an actuating valve communicating with said second end of said tilt cylinder and biased to releasably prevent fluid flow therethrough from said second end of said tilt cylinder, and means operative in response to fluid flow through said actuating valve for temporarily opening said by-pass valve to afford hydraulic fluid flow from said first end of said tilt cylinder to said second end of said tilt cylinder.

11. A marine propulsion device in accordance with claim 9 wherein said by-pass valve communicates with said second end of said tilt cylinder through conduit means including valve means preventing flow from said second end of said tilt cylinder to said by-pass valve.

12. A marine propulsion device in accordance with claim 11 wherein said conduit means includes a reservoir between said by-pass valve and said valve means.

13. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through one of said ends of said trim cylinder and adapted for releasable engagement with the other of said member and said propulsion assembly, a reversible pump including first and second ports, said pump being operative, when said pump is operating in a first mode, to supply hydraulic fluid under pressure at said first port and to provide suction at said second port and being operative, when said pump is operating in a second mode, to supply hydraulic fluid under pressure at said second port and to provide suction at said first port, a sump communicating with said first and second ports, first conduit means communicating between said first end of said tilt cylinder and said first pump port and including a first valve biased so as to releasably prevent flow from said first end of said tilt cylinder to said first pump port and so as to permit fluid flow from said first pump port to said first end of said tilt cylinder in response to the presence of hydraulic fluid under pressure at said first pump port, second conduit means communicating between said first end of said trim cylinder and said first pump port independently of said first valve means, third conduit means communicating between said second pump port and said second ends of said trim cylinder and said tilt cylinder independently of said sump to permit pressure fluid flow from said second pump port to said second ends of said trim and tilt cylinders, and means communicating with said second pump port for actuating said first valve against the bias thereof and in response to the presence of hydraulic fluid under pressure at said second pump port so as to permit hydraulic fluid flow from said first end of said tilt cylinder to said first pump port.

14. A marine propulsion device in accordance with claim 13 wherein said first valve includes a valve seat, a valve member movable relative to said valve seat between an open position permitting fluid flow through said first valve and a closed position preventing fluid flow through said first valve, and a spring biasing said valve member toward said closed position, and wherein said means for actuating said first valve comprises a housing having therein a cylinder with a first end communicating with said second pump port, a second end communicating with said first conduit means intermediate said first valve and said first pump port, and a piston located in said cylinder intermediate the ends thereof and being movable in said cylinder relative to a position engaging said valve member to displace said valve member to said open position in response to the presence of hydraulic fluid under pressure at said first cylinder end.

15. A marine propulsion device in accordance with claim 14 wherein said housing includes a portion of said first conduit means including said valve seat and wherein said valve member and said spring are located in said housing.

16. A marine propulsion device in accordance with claim 13 wherein said first and second conduit means communicate with said first pump port independently of each other.

17. A marine propulsion device in accordance with claim 13 and further including a normally closed relief valve communicating between said first conduit means and said sump and arranged to afford fluid flow from said first conduit means in the event of a pressure therein above a predetermined level.

18. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through one of said ends of said trim cylinder and adapted for releasable engagement with the other of said member and said propulsion assembly, a reversible pump including first and second ports, said pump being operative, when said pump is operating in a first mode, to supply hydraulic fluid under pressure at said first port and to provide suction at said second port and being operative, when said pump is operating in a second mode, to supply hydraulic fluid under pressure at said second port and to provide suction at said first port, first conduit means communicating between said first end of said tilt cylinder and said first pump port and including a first valve biased so as to releasably prevent flow from said first end of said tilt cylinder to said first pump port and so as to permit fluid flow from said first pump port to said first end of said tilt cylinder in response to the presence of hydraulic fluid under pressure at said first pump port, second conduit means communicating between said first end of said trim cylinder and said first pump port and including a second valve biased so as to releasably prevent flow from said first end of said trim cylinder to said first pump port and so as to permit fluid flow from said first pump port to said first end of said trim cylinder in response to the presence of hydraulic fluid under pressure at said first pump port, third conduit means communicating between said second pump port and said second ends of said trim cylinder and said tilt cylinder, first means communicating with said second pump port for actuating said first valve against the bias thereof and in response to the presence of hydraulic fluid under pressure at said second pump port so as to permit hydraulic fluid flow from said first end of said tilt cylinder to said first pump port, and second means communicating with said second pump port for actuating said second valve against the bias thereof and in response to the presence of hydraulic fluid under pressure at said second pump port so as to permit hydraulic fluid flow from said first end of said trim cylinder to said first pump port.

19. A marine propulsion device in accordance with claim 18 wherein said first valve includes a valve seat, a valve member movable relative to said valve seat between an open position permitting fluid flow through said first valve and a closed position preventing fluid flow through said first valve, and a spring biasing said valve member toward said closed position, and wherein said first means for actuating said first valve comprises a housing having therein a cylinder with a first end communicating with said second pump port, a second end communicating with said first conduit means intermediate said first valve and said first pump port, and a piston located in said cylinder intermediate the ends thereof and being movable in said cylinder relative to a position engaging said valve member to displace said valve member to said open position in response to the presence of hydraulic fluid under pressure at said first cylinder end.

20. A marine propulsion device in accordance with claim 19 wherein said housing includes a portion of said first conduit means including said valve seat and wherein said valve member and said spring are located in said housing.

21. A marine propulsion device in accordance with claim 19 wherein said second valve includes a valve seat, a valve member movable relative to said valve seat between an open position permitting fluid flow through said second valve and a closed position preventing fluid flow through said second valve, and a spring biasing said valve member toward said closed position, and wherein said second means for actuating said second valve comprises a housing having therein a cylinder with a first end communicating with said second pump port, a second end communicating with said second conduit means intermediate said second valve and said first pump port, and a piston located in said cylinder intermediate the ends thereof and being movable in said cylinder relative to a position engaging said valve member to displace said valve member to said open position in response to the presence of hydraulic fluid under pressure at said first cylinder end.

22. A marine propulsion device in accordance with claim 21 wherein said housing includes a portion of said second conduit means including said valve seat and wherein said valve member and said spring are located in said housing.

23. A marine propulsion device in accordance with claim 19 wherein said first and second conduit means communicate with said first pump port independently of each other.

24. A marine propulsion device in accordance with claim 19 and further including a normally closed relief valve communicating between said first conduit means and a sump and arranged to afford fluid flow from said first conduit means in the event of a pressure therein above a predetermined level.

* * * * *